US005404944A

United States Patent [19]

Lynde et al.

[11] Patent Number: 5,404,944

[45] Date of Patent: Apr. 11, 1995

[54] DOWNHOLE MAKEUP TOOL FOR THREADED TUBULARS

[75] Inventors: Gerald Lynde, Houston; Ralph D. Wright, Tomball; Richard A. Sukup, Burlesor; Patrick R. Brand, Plano, all of Tex.

[73] Assignee: Baker Hughes, Inc., Houston, Tex.

[21] Appl. No.: 126,379

[22] Filed: Sep. 24, 1993

[51] Int. Cl.[6] ..... E21B 23/00

[52] U.S. Cl. ..... 166/117.7; 166/237; 175/322

[58] Field of Search ..... 166/120, 301, 382, 383, 166/117.7, 237; 175/320, 321, 322, 323

[56] References Cited

U.S. PATENT DOCUMENTS

| | | | |
|---|---|---|---|
| 3,276,824 | 10/1966 | Carter | 175/325.3 |
| 3,526,284 | 9/1970 | Burge | 175/321 |
| 4,078,606 | 3/1978 | Montgomery | 166/120 |
| 4,270,620 | 6/1981 | Lawrence | 175/322 |
| 4,562,889 | 1/1986 | Braddick | 166/381 |
| 4,942,924 | 7/1990 | Duncan | 166/382 X |
| 4,942,925 | 7/1990 | Themig | 166/382 |
| 5,018,582 | 5/1991 | Baker | 166/382 |
| 5,224,547 | 7/1993 | Burns, Sr. et al. | 166/301 |

OTHER PUBLICATIONS

Brochure 4035B, Tri-State Oil Tools, Inc., "Tri-State Casing Back-Off Tool", 1988.

Brochure 4036B, Tri-State Oil Tools, Inc., "Tri-State Reversing Tool", 1988.

Brochure 6020B, Tri-State Oil Tool Industries, Inc., "Tri-State Regular and Slim Series Lead Seal Casing Patches".

Brochure, Tri-State Oil Tools, "Workover Report", 1989.

*Primary Examiner*—Ramon S. Britts

*Assistant Examiner*—Frank S. Tsay

*Attorney, Agent, or Firm*—Browning, Bushman, Anderson & Brookhart

[57] ABSTRACT

A downhole tool for making up threaded connections between lower and upper tubulars within a well bore includes a lower anchoring member, an upper anchoring member, and a drive member including a movable piston assembly. A plurality of straight splines on the piston assembly and mating splines on a housing rotatable with the lower anchoring member allow axial movement while preventing rotational movement of the piston assembly with respect to the lower anchoring member during the tool driving stroke. The helical drive component on the piston assembly and a mating driven component rotatable with the upper anchoring member cooperate to rotate the upper anchoring member and thus the upper tubular to make up the downhole threaded connection. According to the method of the present invention, the upper and lower anchoring members are each secured to a respective tubular, and fluid pressure is increased to drive the piston assembly downward, thereby rotating the upper tubular. A torque sub may be provided including strain gauges for measuring makeup torque And for transmitting representative signals to the surface during the makeup operation.

10 Claims, 7 Drawing Sheets

DOWNHOLE MAKEUP TOOL FOR THREADED TUBULARS

FIELD OF THE INVENTION

The present invention relates to methods and apparatus for making up a threaded connection between tubulars while positioned downhole within a well bore. More particularly, the present invention relates to a downhole makeup tool which utilizes hydraulic pressure transmitted from the surface to the downhole tool for connecting threads of axially aligned tubulars, and to a method of making up the downhole connection which significantly increases the high pressure integrity of the connected tubulars.

BACKGROUND OF THE INVENTION

Various equipment and techniques have been devised for rotating a downhole tubular member, such as a section or joint of casing or drill pipe. Those skilled in hydrocarbon recovery operations appreciate that various anticipated or unexpected problems require either the makeup of tubulars downhole to provide a fluid-tight threaded connection, the breaking out of tubulars to structurally separate one tubular section from another tubular section, or the desired rotation of a tubular section which does not extend to the surface of the well. Tools and techniques which can reliably perform these operations in a cost efficient manner having long been desired by the hydrocarbon recovery service industry.

To provide a downhole breakout operation, it is conventional to apply left hand torque to the tubular string from the surface, then jar or shock the tubular string in the vicinity of the connection to be broken apart. The jarring or shocking action may be imparted by a jarring tool, or by a downhole explosive device set off near the connection to be broken. This technique, while having the benefit of relatively low cost, is not highly reliable. Any threaded connection above that to be separated is inherently subjected to the same or a higher left hand torque, and thus these upper connections may unintentionally separate before the connection to be broken apart separates. To provide the desired high reliability to break out the downhole tubular connection, back-off tools have been developed which are lowered downhole on a work string to straddle and unscrew the connection to be separated. A prior art casing back-off tool offered by Tri-State Oil Tools, Inc. includes an upper member for anchoring to the casing above the connection to be broken, a lower member for anchoring to the casing below the connection to be broken, and an intermediate back-off tool portion. Right hand threads are used throughout the breakout tool, and hydraulic pressure applied from the surface causes axial and rotational movement of a hydraulically responsive piston, which then rotates the upper anchoring member and thus the casing interconnected therewith, breaking apart the threaded connection. High breakout forces are typically required to "break" the connection, and thereafter relatively low forces are required to repeatedly stroke the piston to completely separate the threaded casing connection.

In another situation, a casing may become stuck in the borehole, and the drilling operator may separate and remove the upper section of casing, while leaving the lower stuck casing downhole. The drilling operator thereafter need rotate only the stuck lower casing to free it from the borehole. In this case, a hydraulically operated reversing tool may be positioned downhole on a work string above the stuck casing, and may be activated to apply a left-hand torque to the stuck lower casing to hopefully unstick the casing from the wellbore. A Tri-State reversing tool includes an upper member for securing the tool within the wellbore, and a lower reversing portion which connects with the upper end of the stuck casing. Hydraulic fluid axially moves and rotates a driving piston, which transmits the desired reversing torque to the downhole tubular. The reversing tool includes an exterior spline to keep applied torque in the stuck casing, and generates left hand torque to unscrew the "fish" or stuck tubular.

While back-off tools and reversing tools have long been used in the oil recovery service industry, a practical downhole tool is not being used for makeup of a downhole tubular connection. Particular problems arise with respect to makeup of a downhole connection, which problems are not encountered when breaking out a connection or when utilizing a reversing tool to unstick a downhole tubular section. For example, when breaking out a tubular connection, damage to the connection threads is not envisioned, and there are no problems concerning alignment of the tubulars since the connection is already made up. Also, a relatively high torque must be initially applied to break out the connection, and thereafter only a comparably low torque need be applied to complete the break-out operation. By comparison, damage to the threads of the connection is a significant concern during a downhole makeup operation. Also, axial alignment of the tubulars must be performed prior to a downhole makeup operation, and a relatively low initial torque and a high final torque are required when making up the downhole connection.

The hydrocarbon recovery service industry has accordingly continued to accept the substantial risks associated with making up downhole tubular connections by trying to "stab-in" the upper tubular threads to the lower tubular threads, and then rotating the upper tubular from the surface to complete the makeup operation. Those skilled in the art have long recognized that the threaded ends of the tubular connections become damaged during this stabbing operation, since the tubulars to be connected are seldom centrally aligned within the borehole. Even if the stabbing connection is successfully made, it is difficult to estimate the torque which is actually applied to the downhole connection during the makeup operation, since a significant difference exists between the torque applied to the tubular at the surface compared to the torque applied to the downhole connection, particularly if the tubular is within a deviated well. The technique of making up a downhole connection by turning the tubular at the surface is thus at best reliable only if there is little torque resistance in the tubular string extending to the surface. Since the wellbore walls are typically engaged by the tubular string and add substantial torque resistance, the desired downhole torque cannot be assumed to be the torque applied to the tubular string at the surface.

In many instances, the stabbing operation damages the threads, particularly when tubulars employing premium threads having metal-to-metal seals adjacent end surfaces of the tubulars are utilized. The upper tubular string then is typically removed from the wellbore, and a downhole tool inserted to cutoff the lower tubular section below the damaged threads. The lower end of the upper tubular string section similarly may be modified so that a seal and latch assembly or casing patch device may subsequently be utilized to form a seal between the adjoining unthreaded tubular ends within the wellbore. The casing patch device thus stabs over the cutoff tubular, and relies on the sealing medium of the patch, which may be lead, to seal the casing joints together. Other patches utilize metal-to-metal seals to offer more reliability than elastomeric materials or lead as a sealant, although these patches must have special clearances and surface finishes which often cannot be economically obtained throughout the life of the well. Special patch repair equipment and techniques have thus been devised to sealingly connect the downhole upper and lower tubular sections when the threaded ends have been removed from the tubulars to be connected. These patch operations are not favored by those skilled in the industry, however, and significant risks are encountered when utilizing this patch technique, particularly when the tubular string is thereafter subjected to repeated high pressure and de-pressuring operations. The patch thus may be unable to withstand the dynamic forces subsequently generated by casing movements and/or downhole temperature fluctuations.

Even if a tubular connection is made up downhole by applying torque to the upper tubular section at the surface, the threaded connection may not form the desired reliable seal when subjected to high pressure, due to damage of the threads during the stab-in or makeup operation. In other instances, pressure tests on the integrity of the downhole made up connection may indicate a successful makeup, but the connection thereafter may fail since excessive torque or an insufficient torque may have been applied during the makeup operation, resulting in failure after the made up connection has been in use for a period of time. Tubulars manufactured from special corrosion resistant material are often used to enhance the useful life of the recovery operation. Premium connections used in oil country tubular goods require the reasonably accurate monitoring of torque during the makeup operation if the integrity of the connection is to be guaranteed, and this goal is typically not obtained when rotating a tubular at the surface to complete the makeup operation.

The disadvantages of the prior art are overcome by the present invention. A downhole makeup tool and an improved method of making a reliable downhole threaded connection are hereinafter disclosed which overcome the disadvantages of the prior art. The downhole makeup tool and the technique of the present invention are thus able to reliably makeup a downhole threaded connection, thereby minimizing the risks associated with the recovery of hydrocarbons from a well.

SUMMARY OF THE INVENTION

A suitable embodiment of a downhole makeup tool according to the present invention comprises a rotatable upper anchoring member for securing to the tubular member above the connection to be made up, a lowering anchoring member for securing the tool in place downhole by attaching to the fixed lower tubular member, and an intermediate drive member rotatably secured to the lower anchoring member. The drive member preferably is powered by hydraulic pressure applied from the surface to the tool through the work string on which the tool is lowered into the well. A torque sub may be included in the downhole tool, and houses sensors for monitoring the torque between the upper and lower tubular members during the makeup operation and transmitting representative torque signals to the surface during makeup of the connection. When hydraulic pressure is applied to the piston assembly of the drive member, the piston assembly is forced downward while being prevented from rotation by elongate vertical splines interconnecting the piston assembly and the lower anchoring member. Exterior helical splines on a piston assembly cooperate with mating internal helical splines on a housing secured to the upper anchoring member, such that axial movement of the piston causes rotational movement of the upper anchoring member and thereby transmits makeup torque to the upper tubular member.

According to the method of the present invention, a downhole connection may be easily and reliably made up by positioning an alignment tool within the upper tubular member above the connection threads, then utilizing this tool and selected movement of the upper tubular member to align the lower threads on the upper tubular member with the upper threads on the lower tubular member. Threads on the end of tubulars to be connected will desirably be free of contamination, and a washing operation may have been used to clean the threads at the upper end of the downhole lower tubular member prior to tubular alignment. Rotation of the tubular string at the surface may thereby connect several threads of the connection without applying any significant makeup torque, and the alignment tool may be removed. The makeup tool may then be lowered into the borehole from a work string to straddle the connection to be made up. Hydraulic pressure applied to the tool through the work string may activate the lower anchoring member to first secure the tool in place to the fixed lower tubular member, then the upper anchoring member similarly activated to gripping engage the upper tubular member. The subsequent application of hydraulic pressure to the tool may then drive the piston assembly downward, causing rotation of the upper tubular member. The application of hydraulic pressure at the surface may be regulated to reliably provide the desired makeup torque within reasonable limits. A torque transmitting sub may be utilized within the tool to transmit signals from strain gauges to the surface which are indicative of the actual applied torque to the connection during the makeup operation. Once the downhole connection has been reliably made up, the make up tool may be removed and the connection pressure tested for integrity.

It is an object of the present invention provide a downhole makeup tool for reliably interconnecting tubular threads, thereby minimizing risks associated with damaged downhole threads and with improperly madeup downhole connections.

It is a further object of this invention to provide a method of reliably making up downhole tubulars which applies, within relatively narrow limits, a desired makeup torque to the downhole connection. Torque is not transmitted through the tubular string from the surface to perform the final connection makeup. Torque sensors may be provided within the tool of the present invention for monitoring makeup torque, which signals may then be transmitted to the surface to provide a real time output of makeup torque.

It is a feature of the present invention that the makeup tool includes a piston assembly having lower vertical splines for cooperation with similar splines on a housing rotatable with the lower anchoring member, thereby allowing axial movement of the piston assembly with respect to the lower anchoring member while preventing rotation of the piston assembly during the power stroke of the piston assembly. The piston assembly within the makeup tool may also include upper helical splines for mating with helical splines on a housing rotatable with the upper anchoring member, such that downward axial movement of the piston assembly causes the upper anchoring member to rotate in a makeup direction relative to the lower anchoring member.

It is feature of the present invention that the same tool and makeup techniques may be utilized to connect a lower tubular member or lower tubular string within a borehole either with an upper tubular string extending to the surface, or with a tubular seal and latching member serving as the upper tubular member. Once the threads on the tubular seal and latching member are properly connected to the lower tubular member, a seal and latch assembly may interconnect the upper tubular string to the upper end of the tubular seal and latch member, which is configured to sealingly receive the seal and latch assembly.

It is an advantage of the present invention that the makeup tool may utilize components, including upper and lower anchoring members, which have been reliably utilized in other downhole operations.

It is another advantage of the present invention that conventionally available surface equipment and techniques may be used to monitor the axial load on the tubular string during the makeup operation, and to compensate for downward movement of the upper tubular member during the makeup operation.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
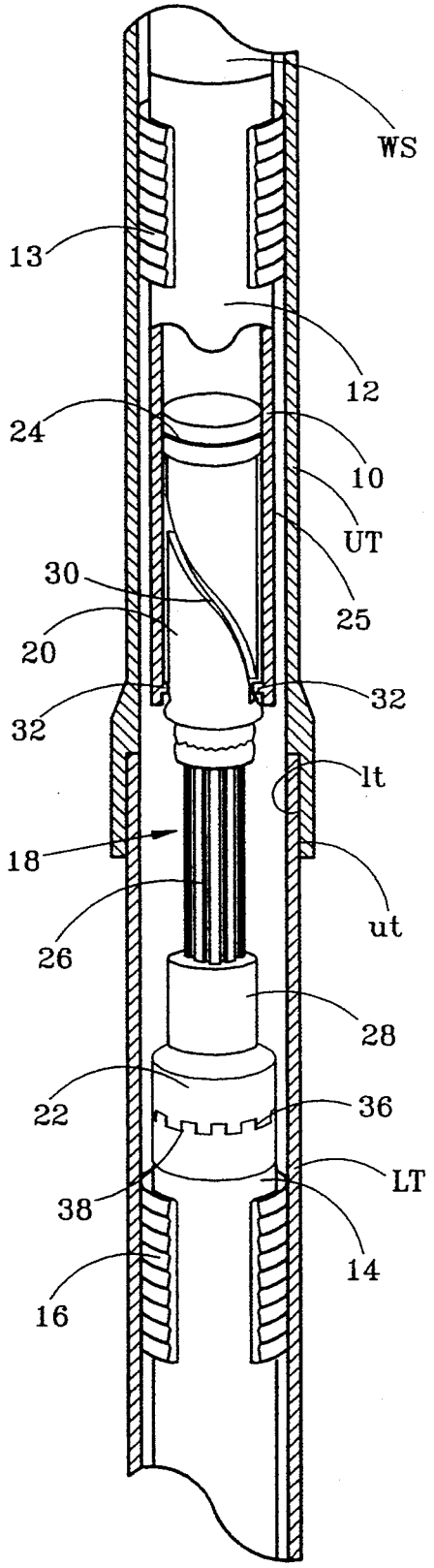
FIG. 1 is a simplified schematic representation of a downhole makeup tool according to the present invention prior to stroking of the tool.
Figure 2:
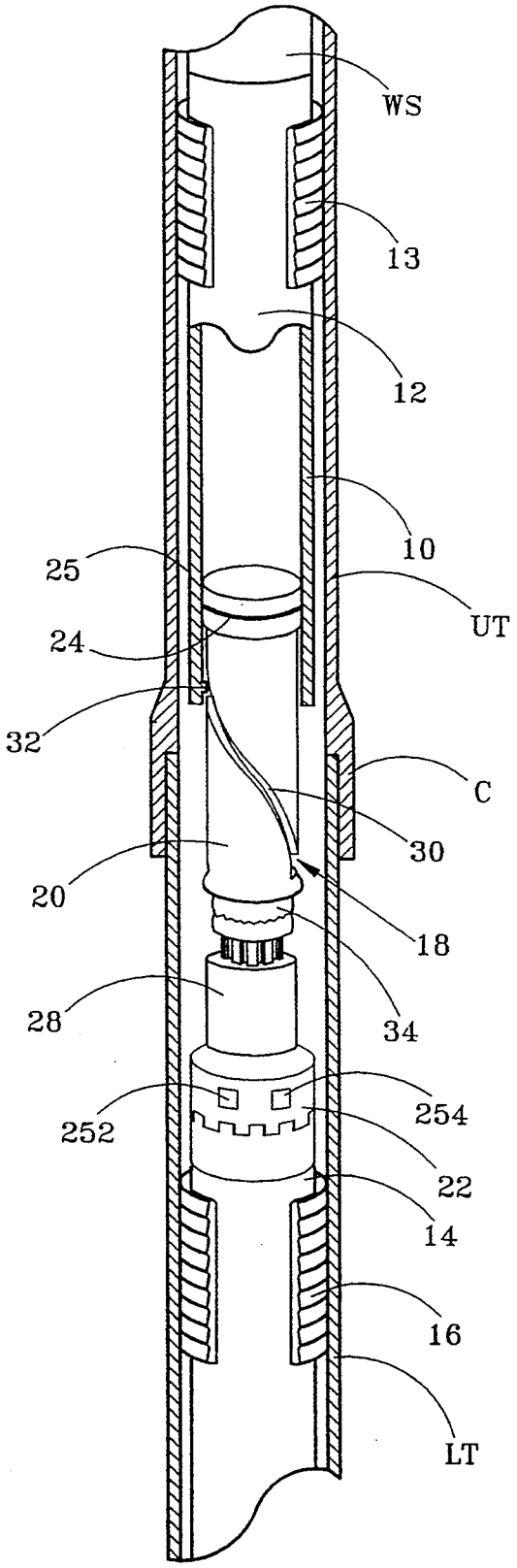
FIG. 2 is a simplified schematic representation of the makeup tool as shown in FIG. 1 subsequent to the stroking of the tool and after having successfully made up a downhole threaded connection.
Figure 3:
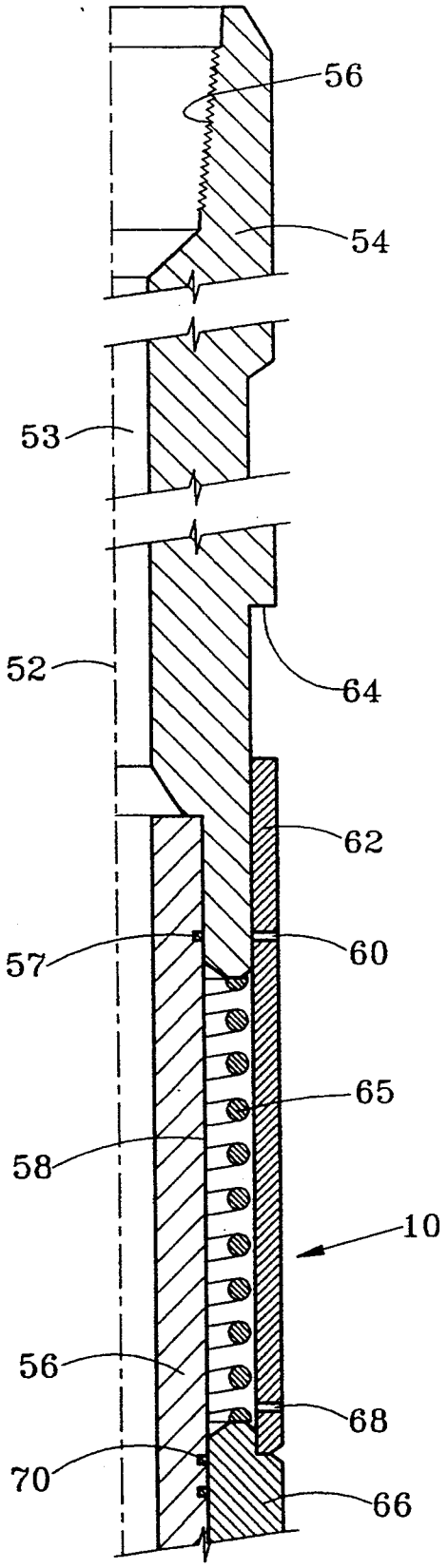
FIGS. 3–10 are each half-sectional views of a makeup tool according to the present invention, with portions of the tool being removed to illustrate the functional components of the tool. The lower portion of a figure corresponds with to the upper portion of the consecutively higher numbered figure.

The makeup tool of the present invention and its operation may be initially appreciated by reference to the conceptual drawings of the tool as shown in FIGS. 1 and 2. The makeup tool 10 comprises an upper anchoring member 12 including radially moveable gripping dies or slips 13, and a lower anchoring member 14 including similar slips or dies 16. An axially intermediate drive member 18 includes a piston assembly 20. If desired, the assembly 10 may also include a torque sensing and data transmission sub 22 generally positioned as shown in FIGS. 1 and 2.

The piston assembly 20 includes a sealing member 24 for dynamic sealing engagement with the interior cylindrical surface of sleeve 25, which in turn is secured to the upper anchoring member 12 during the driving stroke of the tool, as described subsequently. The piston assembly includes a downwardly extending sleeve or mandril 26 having a plurality of external elongate vertical splines thereon, which splines mate with the internal splines provided on housing 28, which in turn is secured to the lower anchoring member 14 during the driving stroke of the tool. A plurality of exterior helical splines on the piston assembly 20 are shown schematically by helical groove 30 in FIGS. 1 and 2, and these external piston assembly splines engage mating splines on the housing 25, which are schematically represented by protrusions 32.

The drive member 18 includes a pair of clutch assemblies discussed subsequently, and a representative clutch assembly 34 is depicted in FIG. 2. For the present, it should be understood that the clutch assemblies facilitate repeated stroking of the piston assembly during the makeup operation described subsequently. Also, it should be understood that high torque forces need not be transmitted through the threads of the threadedly connected housings within the makeup tool, and instead this torque transmission function may be reliably performed by using mating downwardly extending housing teeth 36 and upwardly extending housing teeth 38 to reliably transmit torque between upper and lower housings of the tool 10.

The downhole makeup operation will now be described with respect to the tool schematically illustrated in FIGS. 1 and 2. For exemplary discussion purposes, it may be assumed that the upper threads ut on the lower tubular LT have been cleaned as much as reasonably possible, and that an alignment tool may have been used to align the upper tubular UT with respect to the lower tubular LT. The upper tubular UT may be rotated at the surface or otherwise, so that the lower threads It matingly engage the upper threads ut, although no significant torque has yet been applied to the connection, since that torque will be supplied by the makeup tool 10 according to the present invention. It should be understood that the upper and lower tubulars may be of various sizes and types, and that the connection C to be made up downhole may have a pin and box configuration commonly used in drill pipe, or a coupling configuration commonly used in casing. Also, the threads It and ut may be of any type, and the invention is particularly well suited for making up premium threads having metal-to-metal sealing surfaces, since these surface would frequently become damaged by conventional stab-in and surface torquing operations, but are protected and serve to reliably makeup a connection when utilizing the makeup tool 10.

With the tubulars LT and UT loosely interconnected as shown in FIG. 1, the makeup tool 10 may be lowered into the wellbore from a work string WS until the tool is positioned to straddle a connection to be made up.

Hydraulic pressure may then be transmitted from the surface to the tool through the work string, and causes actuation of the lower anchor member 14 so that slips 16 grippingly engage the lower tubular LT, which is stationary within the wellbore. The subsequent increase of pressure in the work string causes actuation of the upper anchor member 12, so that the slips 13 similarly engage the upper tubular UT. The piston assembly 20 as shown in FIG. 1 is biased upward by springs (not shown), and is forced downward when the fluid pressure in the work string is further increased. The vertical splines on the sleeve 26 of the piston assembly 20 mate with the lower splines on the housing 28, and allow downward movement of the piston assembly toward the anchor member 14 during the piston stroking operation, so that the piston assembly 20 moves downward to the position as shown in FIG. 2 while the work string WS remains substantially stationary. Due to the spiral or helix interconnection of the piston assembly and the housing 25, this piston stroking operation rotates the housing 25, and thus the upper anchor member 12 and the tubular UT. Looking downward at the tool, clockwise rotation of the piston assembly 20 is prevented by the vertical splines which rotatably fix the piston assembly to the fixed lower anchor 14, and accordingly the housing 25 must rotate clockwise during the stroking operation, thereby rotating the upper tubular UT in the makeup direction.

A single stroking operation of the tool from the position as shown in FIG. 1 to the position as shown in FIG. 2 will cause a typical rotation of approximate ½ turn of the upper tubular, and accordingly the tool must be repeatedly stroked to perform the desired makeup operation. Fluid pressure in WS may thus be released, so that biasing springs return the piston assembly from the FIG. 2 position to the FIG. 1 position. The tool is thereafter again stroked in a downward driving action, then again returned by the springs, until the makeup operation is complete. During the final makeup stroke, the fluid pressure at the surface may be easily monitored, and the fluid pressure just above the piston assembly calculated, so that a known fluid pressure and a known piston face area will produce a determinable axial force, which in turn produces a determinable torque for the makeup operation. The fluid pressure may thus be continually increased until the desired makeup torque for the connection is obtained. Charts may be utilized so that the drilling operator may easily determine that, for a particular type of connection, a fluid pressure in the work string at the surface should be at a preselected value when using a specific tool 10 in order to perform the desired makeup operation. Once this desired pressure level is obtained in the work string at the surface, the connection will be properly made up as shown in FIG. 2, and the tool 10 may be removed from the well.

Before discussing the tool 10 in further detail, it should now be understood that the upper tubular UT may be a length of casing or drill pipe, which in turn is part of a tubular string extending to the surface. In this case, rotation of the string at the surface may be observed during each stroking operation of the tool. The makeup tool 10 may thus be stroked to makeup the desired connection downhole in the same reliable manner that the connection would be made up at the surface with power tongs or a bucking unit. During the downhole makeup operation, a load cell above the elevator may be used to monitor the axial load on the tubular string during the makeup operation. Also, a hydraulic cylinder assembly or other suitable mechanism may be provided at the surface to support the tubular string, and serve as a slack off device to compensate for downward movement of the upper tubular as the connection is made up. The hydraulic cylinder assembly may thus lower the tubular string at the same rate required for the lower tubular to move downward during the makeup operation in response to the torque induced by the tool 10.

In the alternative, the upper tubular UT may be a conventional tubular of a polished bore receptacle or PAR, with the tubular having lower threads for making up with the upper threads on the lower tubular to form a connection utilizing the tool 10 of the present invention. In this case, the polished bore tubular may have an upper end designed for receiving a seal and latching mechanism which is conventionally used in oil recovery operations. The upper end of the polished bore tubular may thus be specially prepared for sealing engagement with the lower end of a tubular positioned above the polished bore tubular, utilizing a conventional seal and latching assembly. The desired threaded connection between the polished bore tubular and the lower downhole tubular is thus still made up with the tool 10. The same makeup tool accordingly may be used to make up connections which are part of a continuous string, or the make up tool may be used to interconnect a lower tubular to a tubular of a seal and latching device, which may subsequently be connected to an upper tubular.

FIGS. 3–10 together depict a half sectional illustration of a suitable embodiment of a makeup tool according to this invention. The lower portion of each figure corresponds structurally to the upper portion of the next figure, and for simplicity some elongate portions of the tool are eliminated in the figures. The tool is thus generally symmetrical about central axis 52, with the tool having a central bore 53 for transmitting fluid pressure to the fluid driven components of the tool, as explained subsequently.

The top sub 54 is provided with threads 56 for mating engagement at the surface with the work string WS generally illustrated in the FIGS. 1 and 2. Mandril 56 is threaded at 58 to the top sub, with O-ring 57 providing a desired fluid-tight seal. When fluid pressure in the bore 53 is increased to activate the upper anchoring member 12, pin or screw 60 is sheared, so that various components including shear sleeve 62 move upward toward surface 64. A spring 65 provided in the annulus between the mandril 56 and sleeve 62 biases cage 66 downward. The spring annulus is open to downhole fluid pressure through port 68, and O-rings 70 maintain sealing engagement between mandril 56 and cage 66 during activation of the anchoring member 12.

Figure 4:
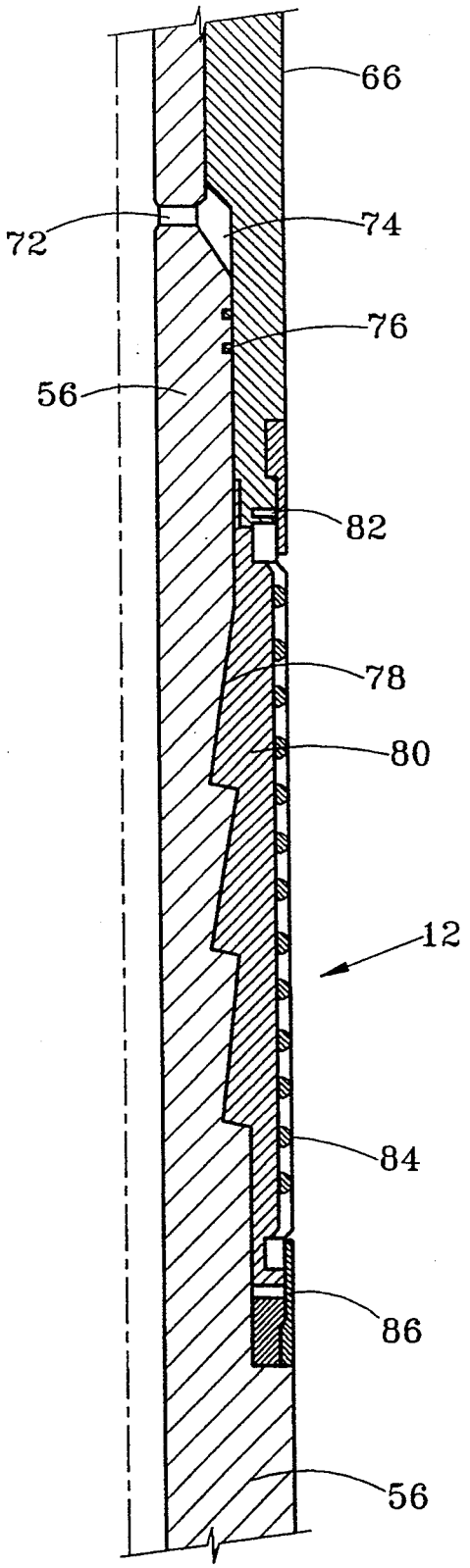

Fluid pressure in the bore 53 activates the anchoring member by passing through port 72 in the mandril to provide fluid communication between the bore 53 and the chamber 74. O-rings 76 provide continuous sealing engagement between the mandril 56 and the cage 66, so that increased pressure in chamber 74 drives the cage 66 and the sleeve 62 upward, sheafing the pin 60 and compressing the spring 65. The lower end of the mandril 56 contains camming surfaces 78 for cooperating with similar surfaces on the slips 80 to force the slips 80 radially outward during the anchoring operation. A keeper block and cap screw assembly 82 may be provided for structurally interconnecting each of the circumferentially spaced slips 80 and the cage 66. A lower keeper block assembly 86 may also be provided at the lower end of the slips 80. Teeth 84 simplistically shown in FIG. 4 on the exterior surface of the slip 80 thus engage the upper tubular to secure the upper anchoring member 12 to the upper tubular. Those skilled in the art will appreciate that the slip 80 as shown in FIG. 4 is one of the circumferentially spaced slip 13 generally shown in FIG. 1.

The lower end of the mandril 56 is threaded to the top makeup sub 88 by threads 90. A piston housing 92 is threadedly connected at 94 to the sub 88, with O-ring 96 providing the static sealing function. For this tool, the piston assembly generally referred to in FIG. 1 comprises an upper piston 98 and a lower piston 100. A plurality of O-rings 102 provide dynamic sealing between the upper piston 98 and the piston housing 92 during stroking of the piston assembly. The upper piston 98 is biased upward toward sub 88 by coil spring 104 provided in the annulus between the upper piston and the piston housing.

Figure 6:
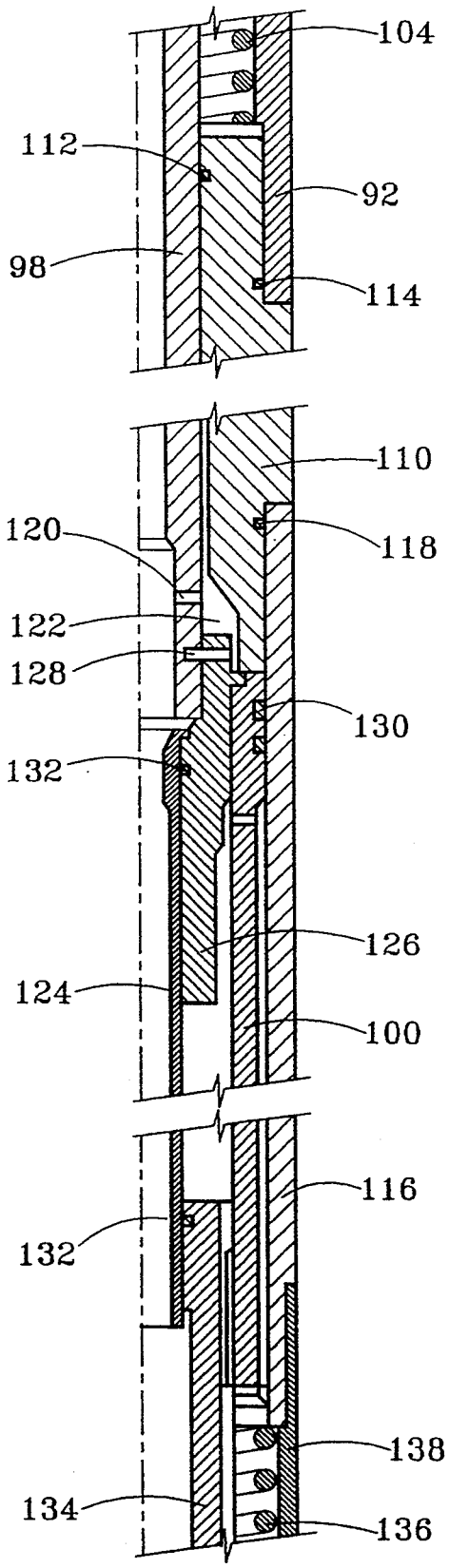

Referring to FIG. 6, outer sub 110 is sealed to piston 98 by dynamic O-ring 112. O-ring 114 provides a static seal between the threadably connected piston housing 92 and the outer sub 110. Cam housing 116 is threaded to the lower end of sub 110, and is sealed by O-ring 118. Port 120 in the lower end of the upper piston 98 provides fluid communication between the bore of the tool and the chamber 122. A radially inward stinger 124, stop member 126, and lower piston 100 are structurally interconnected by a suitable member, such as set screw 128. O-rings 130 provide dynamic sealing engagement between the lower piston 100 and the cam housing 116. O-rings 132 provide sealing engagement between the stinger 124 and both the stop 126 and the upper end of the splined torque shaft 134. Sleeve 138 is threadably connected at its upper end to cam housing 116, and at its lower end to outer collar 140. Coil spring 136 in the annulus between the shaft 134 and sleeve 138 biases the lower piston 100 upward.

Figure 5:
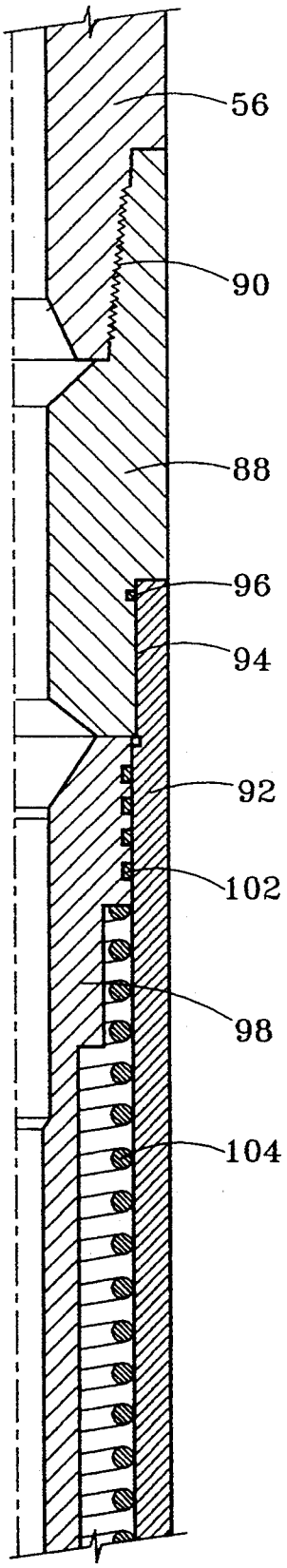
Figure 5A:
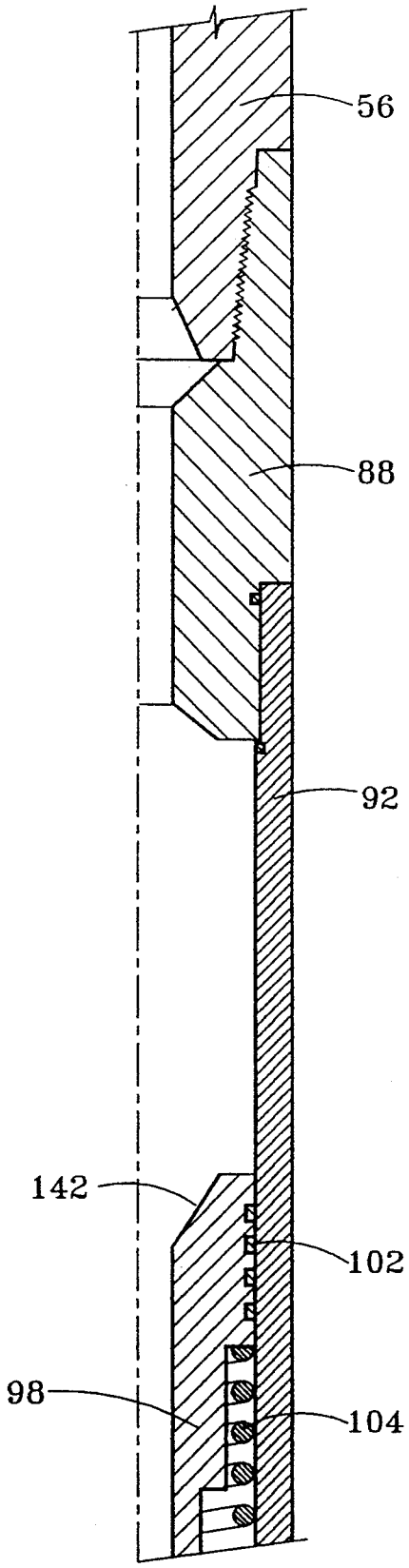
FIG. 5A depicts a portion of the downhole tool as shown in FIG. 5 after the tool has been stroked for performing the makeup rotation.
Figure 6A:
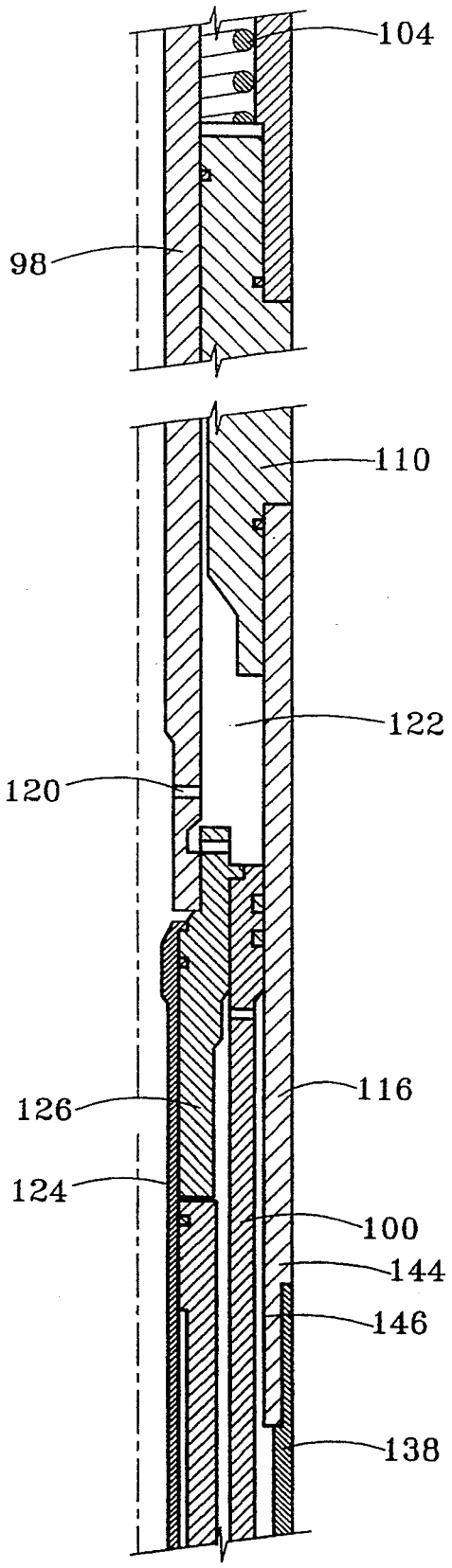
FIG. 6A depicts a portion of the downhole tool as shown in FIG. 6 after the tool has been stroked for performing the makeup operation.

When the piston assembly of the tool 10 according to the present invention is stroked to perform the half-turn makeup operation, the upper piston 98 and lower piston 100 each move from the position as shown in FIGS. 5 and 6 to the position as shown in FIGS. 5A and 6A. Fluid pressure acting on the top surface or face 142 of the upper piston 98 thus drives the upper piston downward, compressing the spring 104. At the same time, fluid pressure passes through the port 120 to increase the volume of the chamber 122, similarly driving the lower piston 100 and both stringer 124 and stop member 126 downward. Although their spiraling configuration is not visible in the FIG. 5 and 6 cross-sectional views, those skilled in the art will readily appreciate that the outer surface of the lower piston 100 may be provided with a plurality of spiraling splines 144 from mating engagement with a corresponding plurality of spiraling splines 146 on the inner surface of the cam housing 116. Accordingly, axial movement of the piston assembly relative to the cam housing inherently causes relative rotational movement between these components. High torque forces may be reliably transmitted between the piston assembly and the cam housing by the mating plurality of spiraling splines 144 and 146. The function of the splines 144 and 146 is thus simplistically illustrated by the spiraling groove 30 and the protrusions 32 as shown in FIG. 1.

Figure 7:
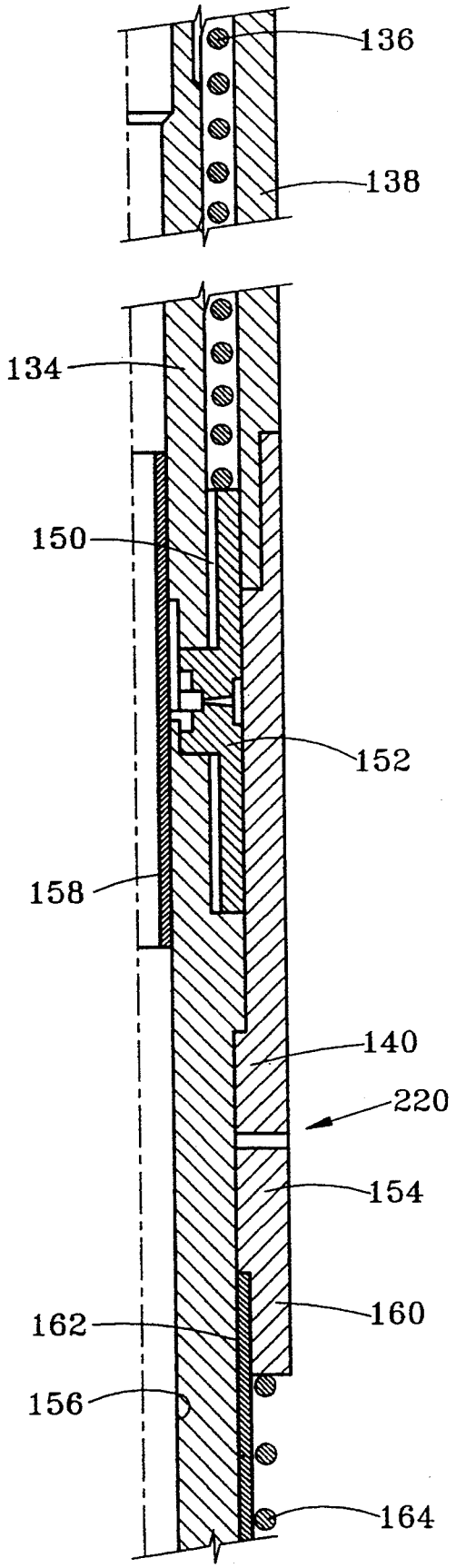

Referring to FIG. 7, the shaft 134 includes a plurality of vertical, straight splines represented at 150, which cooperate with similar upper splines on interior clutch assembly 152. Floating sleeve 158 is provided for sealing engagement with the upper end of the drive shaft 156 and with the lower end of the shaft 134. The inner clutch assembly 152 structurally operates in a conventional manner between the shaft 134 and the drive shaft 156. FIG. 7 depicts in a conventional manner the configuration of the clutch teeth discussed further below.

Figure 8:
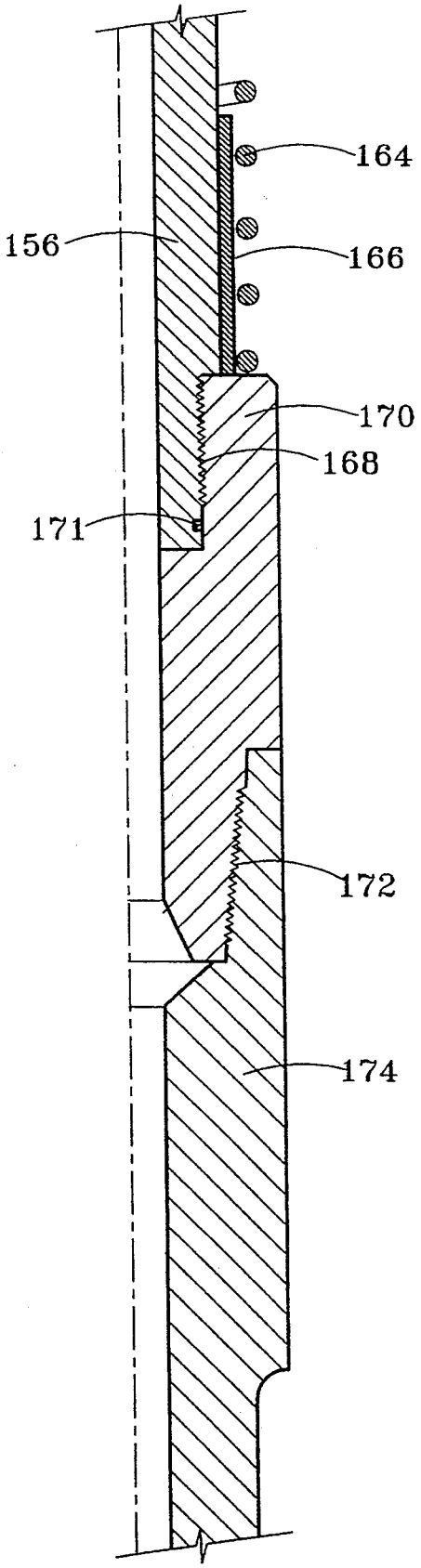
Figure 9:
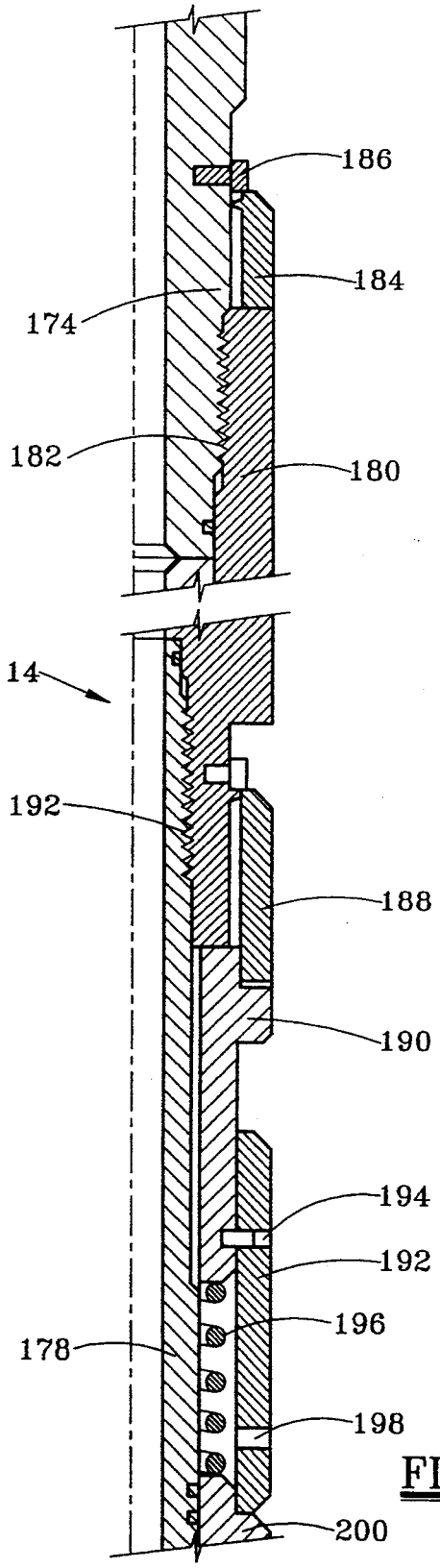
Figure 10:
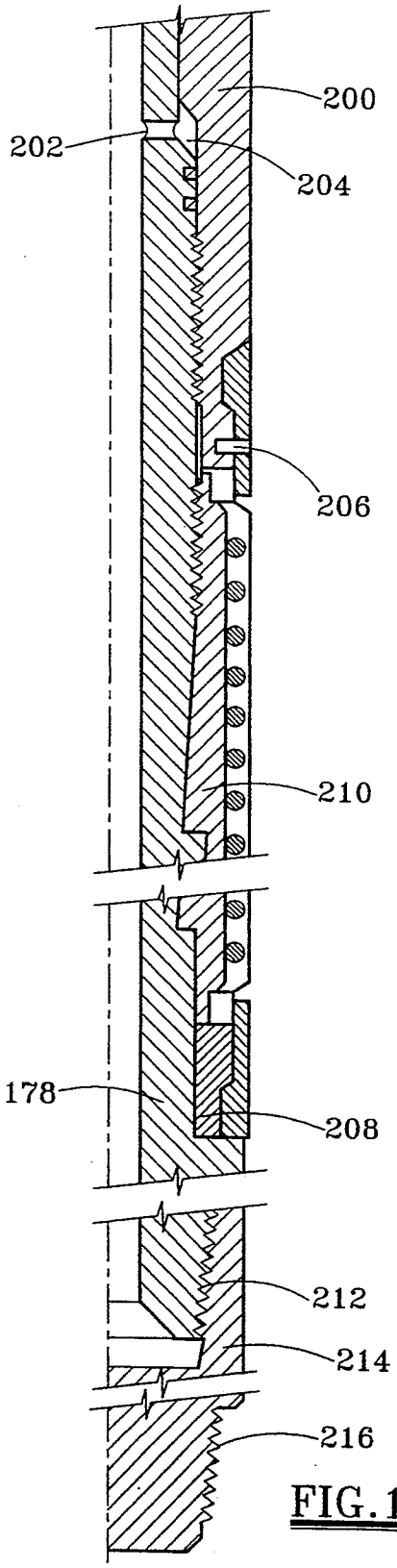

Lower clutch ring 160 is structurally connected to drive shaft 156 by a plurality of straight vertical splines depicted at 162. Lower clutch ring 160 is biased upward by spring 189 toward the clutch collar 140, and stop ring 166 may be provided for limiting downward movement of the clutch ring 160 with respect to drive shaft 156. As shown in FIG. 8, the lower end of the drive shaft 156 is threadedly connected at 168 to bottom makeup sub 170, with O-ring 172 providing the desired seal between sub 170 and drive shaft 156. The outer clutch assembly 220 as shown in FIG. 7 operates in a conventional manner of downhole tool clutch assemblies, and includes mating clutch teeth depicted at 154. The outer clutch assembly 220 thus acts between the sleeve 138 and the drive shaft 156.

The lower end of sub 170 is threadedly connected at 172 to top sub 174 of the lower anchoring member 14. Sub 180 is threadedly connected at 182 to sub 174, although torque between subs 174 and 180 is transmitted through the teeth of component 184, which is splined to sub 174 and is held in place by cap screw 186. The upper end of the sub 180 and the lower end of the component 184 thus have mating teeth for reliably transmitting torque between the subs 174 and 180. The general configuration of these continuously engaged teeth is depicted in FIG. 1 by the downwardly projecting teeth 36 and the mating upwardly projecting teeth 38. Lower clutch component 188 is similarly configured for reliably transmitting torque from the sub 180 to the bottom clutch component 190. Sub 180 is thus threadedly connected at 192 the lower mandril 178, although torque between these components is transmitted through the toothed configuration of the lower component 188 and the bottom clutch component 190.

Shear sleeve 192 is connected to the bottom clutch component 190 by shear pin 194. A spring 196 provided in the annulus between the mandril 178 and the shear sleeve 192 biases the bottom clutch component 190 upward. The spring annulus is vented by port 198. Cage 200 shown in FIGS. 9 and 10 functionally corresponds to cage 66 described above. Flow port 202 in the lower mandril 178 provides fluid communication to the chamber 204, which corresponds to the chamber 74 previously described. An upper keeper block assembly 206, a lower keeper block assembly 208, and the slips 210 correspond to the respective components 82, 86 and 80 previously described. The lower end of the lower mandril 178 is threaded at 212 to the plug mandril 214, which optionally may block flow fluid through the tool 10. If desired, the sub 214 need not entirely block the flow of fluid through the tool, and need only restrict the fluid flow in order to obtain the pressure levels necessary to operate the tool. If desired, the lower end of the sub 214 may be provided with external threads 216 for conventional engagement with equipment to be hung from the end of the makeup tool 10.

Figure 11:
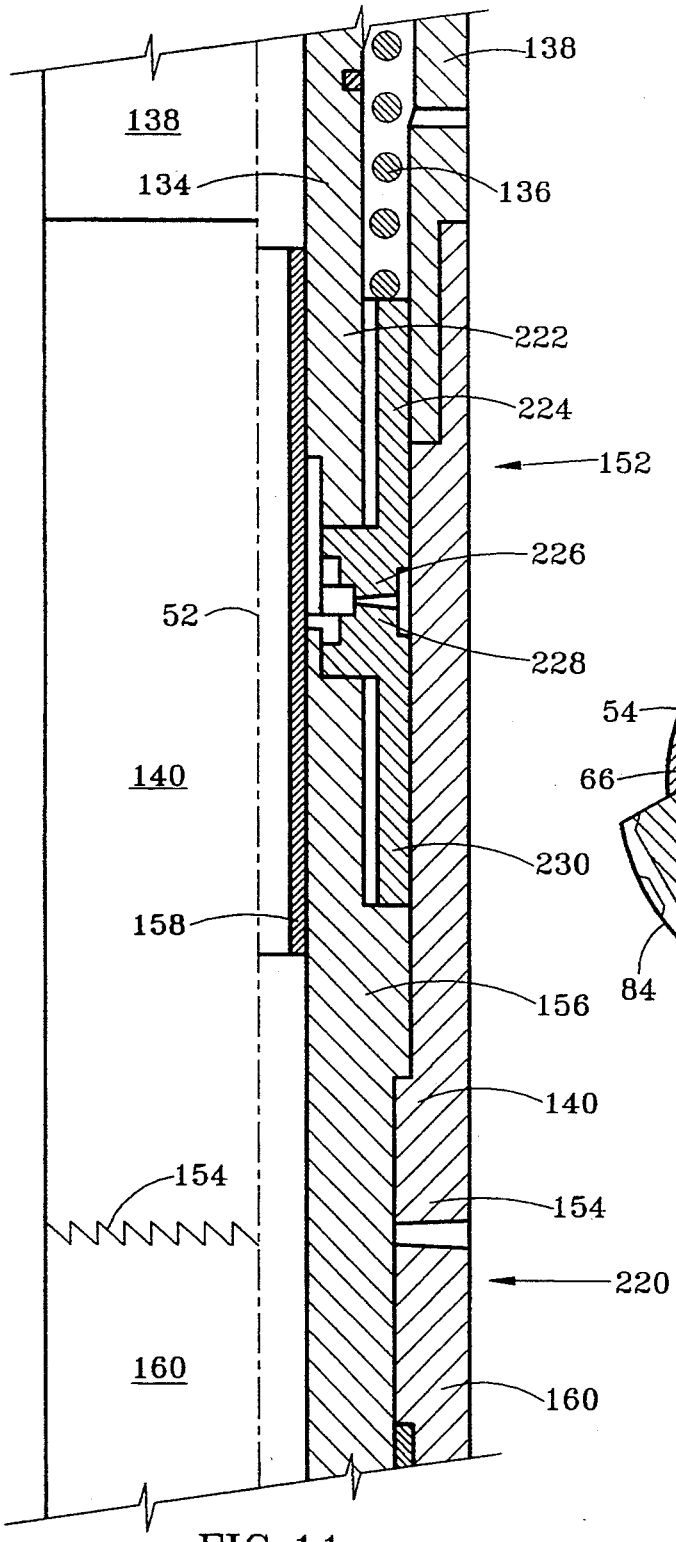
FIG. 11 depicts a portion of the tool as shown in FIG. 7 in greater detail, shown with the right side of the tool being shown in cross-section and the left side of the tool being shown pictorially.

FIG. 11 depicts a half sectional view of a portion of the tool, and more particularly illustrates the inner clutch assembly 152 and the outer clutch assembly 220. Shaft 134 includes a lower splined extension 222, which mates with similar vertical splines on the upper clutch component 224, so that movement between shaft 134 and component 224 is only vertical, i.e.*, parallel to axis 52. The clutch teeth 226 are biased by spring 136 toward mating clutch teeth 228 on lower clutch member 230.

Figure 12:
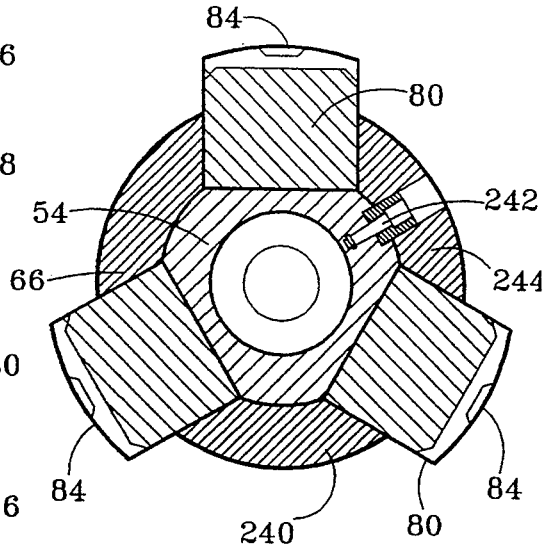
FIG. 12 illustrates a cross-section of the tool through the upper anchoring member.

The clutch teeth 154 of the outer clutch assembly 220 have a configuration frequently shown in downhole tool drawings to the right of centerline 52, although the clutch teeth are depicted pictorially on the left side of centerline 52. The clutch ring 160 is biased toward outer clutch collar 140 by spring 164, which is shown in FIG. 7. The inner and outer clutch assemblies 152 and 220 are each of the type conventionally provided in downhole tools, and respective clutch teeth engage to prohibit rotation between components in one rotational direction, but ratchet under the biasing force of the respective spring to allow rotation of the same components in the opposite direction. FIG. 12 depicts a cross-sectional view of the tool 10 according to the present invention taken through the area of the upper slips. The tool 10 may include three circumferentially spaced slips 80 each having external teeth 84 thereon, with radially movement of the slips 80 being controlled by the relative axial position of the slips 80 with respect to the mandril 56. The mandril 56 in turn may be secured to the circumferentially spaced exterior side wall 240 of the cage 66, with the cage being secured to the mandril 56 by a cap screw 242 and a mandril key 244.

The tool of the present invention as shown in FIGS. 3–10 may have a nominal 5 5/8 inch outer diameter, and is capable of generate up to 25,000 foot pounds of torque at a fluid pressure of approximately 3,600 psi acting on the piston assembly. Those skilled in the art will appreciate that specific sized makeup tools are capable of handling a range of tubulars to be desirably connected downhole. The piston assembly as discussed herein comprises an upper piston and a lower piston, each of which generate a downward axial force which translates to a rotational force on the upper tubular. In other applications, one piston may be sufficient, while for other applications three or more interconnected pistons may be employed.

The method of making up the connection C as shown in FIG. 2 will now be more particularly described. After the threaded ends of the tubulars have been cleaned, an alignment tool such as a packer with a downwardly extending central mandril or guide (Model 300–01 Production Injection Packer manufactured by Baker Oil Tools, and guide) may be used to align the upper and lower tubulars, and the tubulars loosely interconnected by rotating the upper tubular at the surface. Alternatively, the tubulars could be merely engaged, and the downhole makeup tool 10 of the present invention could be used to initially thread the tubulars together. After the alignment tool has been removed, the makeup tool 10 is thus run in the hole at the end of working string WS and positioned across the connection C to be made up. As previously indicated, the upper tubular should be understood to be a conventional tubular, such as a drill pipe or a casing, which may extend to the surface, or could be a tubular member of a latch and seal operation.

Fluid pressure is supplied to the tool 10 at the surface by increasing the pressure in the bore of the work string WS, and thus the bore 53 of the tool 10. This increase of tubing pressure creates a force which shears the pin 194 to actuate the lower anchoring member shown in FIG. 10, and increased fluid pressure thus forces the plurality of lower slips 210 into engagement with the lower tubular LT. After the slips 210 have moved radially outward, the weight of the work string may be increased on the tool 10 to force the slips into further anchoring engagement with the lower tubular. The subsequent increase in pressure similarly then shears the pin 60 shown in FIG. 3, thereby forcing the plurality of upper slips 80 into biting engagement with the pipe. Again, the weight of the work string on the tool 10 may be increased to force the upper slips to fixedly engage the upper tubular UT. If desired, the shear pins may be selected so that the upper anchoring member is activated before the lower anchoring member.

Once the upper and lower anchoring devices have been activated, pressure within the work string may be reduced to allow the piston assembly to return to its fully up position, as shown in FIGS. 5 and 6. The subsequent increase in pressure within the work string will then force the piston assembly comprising upper piston 98 and a lower piston 100 downward, which will induce torque into the tool 10, causing torque to be transmitted to the upper tubular UT to rotate the upper tubular in the makeup direction with respect to the stationary lower tubular LT. During this stroking cycle, the inner clutch assembly maintains the clutch components 224 and 230 as shown in FIG. 11 into biting contact, so that shaft 156 rotates with the drive shaft 134. During this stroking cycle, the outer clutch assembly 220 slips, thereby allowing relative rotation between the outer clutch collar 140 and the clutch ring 160, and thus rotation between the upper anchoring member and the lower anchoring member. During the piston return cycle, the outer clutch assembly maintains the rotational position of the upper anchoring member fixed with the lower anchoring member so that the connection cannot unthread. During this piston return stroke, the inner clutch assembly slips, allowing the piston assembly to rotate relative to the fixed lower anchoring member.

Once the piston assembly has moved to the position as shown in Figs. 5A and 6A, pressure at the surface may be reduced, allowing the springs 140 and 136 to return the piston assembly to the position as shown in FIGS. 5 and 6. In this same manner, the tool 10 of the present invention may be repeatedly stroked, with each downward stroke of the piston assembly rotating the upper tubular UT a certain rotational mount, e.g., ½ turn, with respect to the lower tubular LT. As previously noted, a precise fluid pressure at the surface within the work string WS may be applied so that a specific torque value, typically as recommended by the thread manufacturer, is generated to ensure the structural integrity of the connection. It should be understood that while the connection is being made up, a load cell or other slack-off device may be used to accurately monitor the load on both the work string and the tubular string containing the upper tubular, and that a hydraulic cylinder assembly may be employed at the surface to lower the upper tubular UT at the rate corresponding to the axial descent of the upper tubular with respect to the lower tubular during the makeup operation. By controlling the fluid pressure in the work string, the tool of the present invention ensures that a desired torque load is reliably transmitted to the connection. The drilling operator may utilize charts or conventional calculation techniques in order to determine that, for a specific connection, a certain fluid pressure is necessary in the work string at the surface. Most importantly, the torque induced into the connection is a determinable hydraulic to mechanical ratio, so that the applied pressure be adjusted as a function of the desired torque required for the reliable makeup of the upper tubular with respect to the lower tubular.

After the connection is fully madeup, the fluid pressure in the work string may be reduced, so that springs return the piston assembly to the position as shown in FIGS. 5 and 6. By picking up on the work string, the upper and lower slips will the be retracted in a conventional manner, so that the entire tool 10 may be pulled from the hole. At this point, the integrity of the connection made up downhole may be tested, either by pressurizing the entirety of the string containing the made up connection, or by placing packers or other sealing members above and below the connection, thereby precisely testing the integrity of only the made up connection.

If desired, the downhole makeup tool of the present invention may also contain a torque sub, which may be generally depicted as sub 22 in FIGS. 1 and 2. A plurality of conventional strain gauges represented by members 252 may be provided within the interior of sub 22. Strain gauges 152 measure strain transmitted between the upper anchoring member and the lower anchoring member by the drive member, and output on electrical signal indicative of the monitored strain and thus the actual torque being transmitted through the makeup tool and thus the makeup torque being applied to the connection. The output from the strain gauges 252 may be transmitted to the surface via a conventional electrical conductor line, or may be transmitted via mud pulses through the work string. Torque representative mud pulses may be generated by conventional mud pulse technology, and a generator 254 positioned within the interior of the sub 22 is schematically shown in FIG. 2. The number of turns of the upper tubular with respect to the lower tubular may be monitored by the initial turns required to partially makeup the correction, and the number of times the tool 10 is stroked multiplied by the turn per stroke. The torque sub 22 thus provides for the real time monitoring of actual torque at the surface provided by the makeup device 10, and the total number of turns to perform the makeup operation may be easily monitored at the surface. Alternatively, both torque and turn signals may be transmitted to the surface by the sub 22, allowing the drilling operator to determine the integrity of the downhole connection. In either event, monitoring of torque/and turns may thus be easily accomplished to enhance the prediction of makeup integrity, thereby substantially increasing the reliability of the makeup connection compared to prior art techniques. The tool 10 may thus contain electrical sensors and transmitters to allow transmission of actual generated torque and turn data to the surface. The torque sub may include components similar to MWD technology to allow torque and turn output transmission signals to be sent to the surface via pulsations in the fluid within the work string.

Those skilled in the art will appreciate that various modifications to the tool 10 of the present invention may be made without departing from the spirit of the invention. For example, various devices may be incorporated in the tool to increase the contact area provided by the slips for the desired anchoring function, thereby reducing the unit stress induced into the tubulars. Although biasing member such as springs are preferably utilized to return the piston assembly to the initial starting position as shown in FIGS. 5 and 6 prior to the stroking operation, other techniques may be utilized to return the piston assembly to this position. For example, the annulus between the tubular string and the work tool may be pressurized to return the piston assembly from the position as shown in FIGS. 5A and 6A to the position as shown in FIGS. 5 and 6, or biasing members other than coil springs may be utilized for this function.

The embodiments of the invention as described above and the methods disclosed herein will suggest further modifications and alternations to those skilled in the art. Such further modifications and alternations may be made without departing from the spirit and scope of the invention, which is defined by the scope of the following claims.

What is claimed is:

1. A downhole tool for making up a threaded connection between a lower tubular positioned within a well bore and an upper tubular positioned within the wellbore, the downhole adapter to be suspended within the well bore from a work string extending to the surface, the downhole tool comprising:

a lower anchoring member having a lower connector for selective engagement with the lower tubular;

an upper anchoring member having an upper connector for selective engagement with the upper tubular;

a drive member positioned axially between the lower anchoring member and the upper anchoring member, the drive member including a piston assembly movably responsive to fluid pressure within the work string;

a guide in engagement with the lower anchoring member and the piston assembly for permitting axial movement while preventing rotational movement of the piston assembly with respect to the lower anchoring member;

a helical drive component on the piston assembly; and a mating driven component rotatable with the upper anchoring member and cooperating with the helical drive component to rotate the upper anchoring member and the upper tubular with respect to the lower anchoring member and the lower tubular to make up the downhole threaded connection.

2. The downhole tool as defined in claim 1, wherein the guide comprises:

a plurality of straight splines on the piston assembly each substantially parallel to a longitudinal tool central axis; and a plurality of mating straight splines on a housing rotatable with the lower anchoring member.

3. The downhole tool as defined in claim 2, wherein the plurality of straight splines on the piston assembly are provided on an internal lower surface of the piston assembly.

4. The downhole makeup tool as defined in claim 1, wherein:

the helical drive component comprises a plurality of helical splines on the piston assembly; and the mating driven component comprise a plurality of mating helical splines.

5. The downhole tool as defined in claim 4, wherein:

the plurality of helical splines on the piston assembly are positioned on an exterior surface of the piston assembly; and the mating driven component includes a housing radially exterior of the piston assembly and having the mating helical splines on an interior surface thereof.

6. The downhole tool as defined in claim 1, further comprising:

a clutch for rotatably securing the piston assembly to the lower anchoring member while the piston assembly moves downward during a tool driving stroke, while permitting rotation of the piston assembly relative to the lower anchoring member during the upward return stroke of the piston assembly.

7. The downhole tool as defined in claim 6, further comprising:

another clutch for rotatably securing the upper anchoring member relative to the lower anchoring member during the upward return stroke of the piston assembly, while permitting rotation of the upper anchoring member relative to the lower anchoring member during the tool driving stroke.

8. The downhole tool as defined in claim 1, further comprising:

upper and lower teeth for mating engagement to transmit torque between respective upper and lower threadably connected housings.

9. The downhole tool as defined in claim 1, further comprising:

a torque sub for generating signals indicative of the makeup torque applied to the connection and for transmitting torque representative signals to the surface during makeup of the connection.

10. A downhole tool as defined in claim 1, wherein each of the upper and lower anchoring members includes a plurality of circumferentially spaced slips for engaging a respective tubular, each of the slips being movable radially outwardly in response to fluid pressure within the work string.

* * * * *